United States Patent [19]

McNaghten et al.

[11] Patent Number: 4,546,341

[45] Date of Patent: Oct. 8, 1985

[54] ELECTRICAL CUTOUT HAVING A LINKBREAK LEVER

[75] Inventors: Delmar E. McNaghten; Dennis C. Kent; Robert A. Brown, all of Centralia, Mo.

[73] Assignee: A. B. Chance Company, Centralia, Mo.

[21] Appl. No.: 619,836

[22] Filed: Jun. 12, 1984

[51] Int. Cl.[4] ..... H01H 71/20

[52] U.S. Cl. ..... 337/177; 337/217

[58] Field of Search ..... 337/167, 172, 181, 173, 337/174, 175, 176, 177, 178, 179, 180, 217–220

[56] References Cited

U.S. PATENT DOCUMENTS 2,835,764 5/1958 Earle ..... 337/177

2,836,681 5/1958 Bracey ..... 337/217

*Primary Examiner*—Harold Broome

*Attorney, Agent, or Firm*—Schmidt, Johnson, Hovey & Williams

[57] ABSTRACT

An electrical cutout is disclosed for electrical connection between a line terminal and a load terminal. The cutout includes an insulator having a first and a second end. A first electrical conductor is rigidly secured to the first end of the insulator, the first conductor being electrically connected to the line terminal. A second electrical conductor is rigidly secured to the second end of the insulator, the second conductor being electrically connected to the load terminal. A fuse tube extends between the first and the second conductors and a fuse link extends through the fuse tube and includes a first and a second end. The second end or pigtail of the fuse link is electrically connected to the second electrical conductor. A cap is disposed adjacent the first end of the fuse link, the cap being electrically connected to the first end of the fuse link such that the cap frictionally cooperates with the first conductor. A linkbreak lever for breaking the fuse link is pivotally connected to the second conductor such that when the linkbreak lever is pivoted away from the fuse link in a plane extending through the ends of the insulator and the fuse tube, the moment created by the force required to break the fuse link is opposite in direction and less than the moment resulting from the retentional force between the first conductor and the cap.

18 Claims, 10 Drawing Figures

Fig. 2
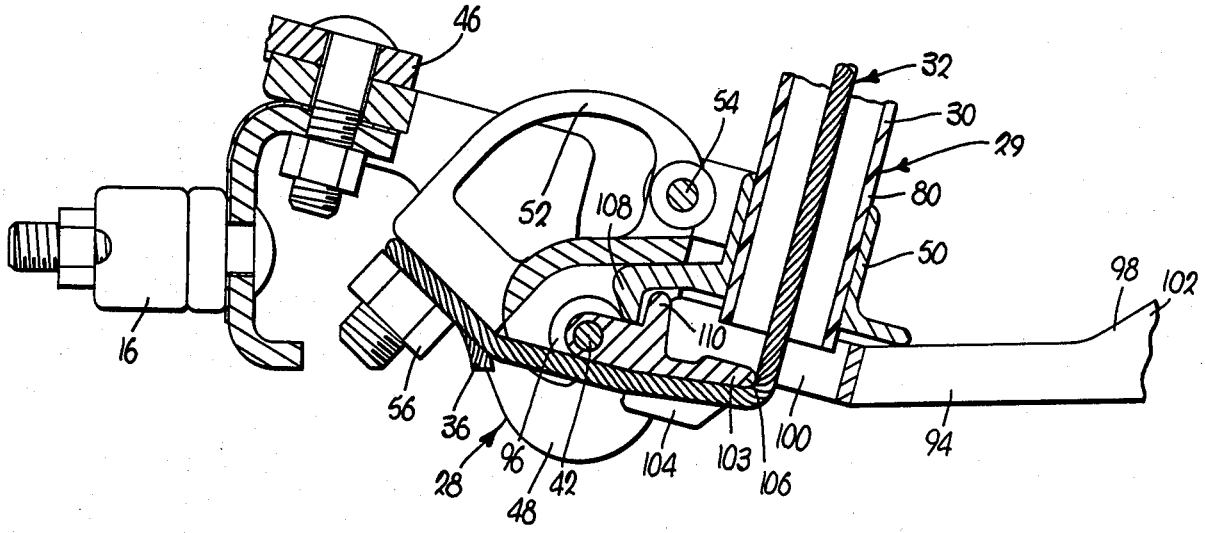
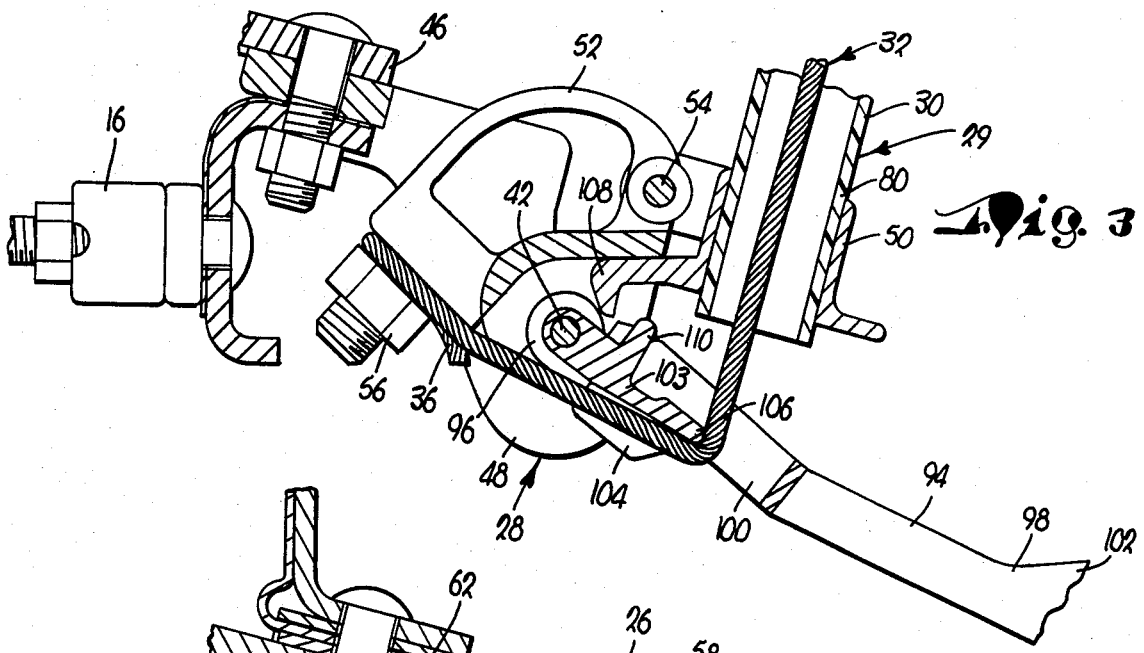
Fig. 3
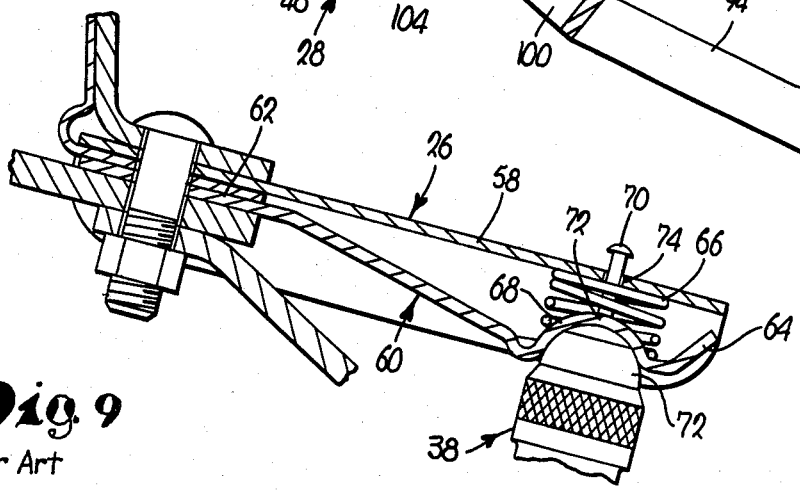
Fig. 9
Prior Art

ELECTRICAL CUTOUT HAVING A LINKBREAK LEVER

BACKGROUND OF THE INVENTION

1. Field of the Invention

This invention relates to an electrical cutout which is electrically connected in series between a line terminal and a load terminal. More specifically, this invention relates to an electrical cutout which includes a linkbreak lever for breaking the fuse link and interrupting the load current prior to disengaging the fuse tube or the like.

2. Information Disclosure Statement

In order to protect transformer equipment and the like in a power supply circuit, it is customary to install an electrical cutout device between the transformer line and the load. These electrical cutouts include a fusible link and removable fuseholder which cooperate automatically with each other to which break the circuit in the event of an electrical overload. Furthermore, such electrical cutouts enable a lineman to manually break the circuit between the transformer and the load.

A typical electrical cutout includes an elongated insulator of porcelain or other ceramic material. The insulator includes an insulator support disposed midway between the ends of the insulator. Usually, the insulator support is embedded within the insulator using an organic or inorganic cement for bonding the insulator support within the insulator. However, the insulator support may be secured to the mid portion of the insulator by means of metal bands or the like. The insulator support is anchored to a line pole or the like and a first and a second electrical conductor are rigidly secured to the first and second ends respectively of the insulator. The line wire from the transformer is connected to the line terminal of the first conductor and the load wire is connected to the load terminal of the second conductor. A removable fuse tube extends between the first and the second conductors and a fuse link having a first and a second end thereof extends through the fuse tube. A fusible head portion of the fuse link is secured between a first end of the fuse tube and a screw fitting cap which cooperates with the first end of the fuse tube. The second end or pigtail of the fuse link extends from the second or lower end of the fuse tube and is anchored in electrical contact with the second electrical conductor. The lower or second end of the fuse tube is pivotally connected to the lower or second conductor and the linesman by means of an insulating line pole pivots the first end of the fuse tube upwardly until the cap abuts against the first conductor and forms an electrical connection therewith. In the prior art, such electrical cutouts usually incorporate a positive latching mechanism for latching the cap into engagement with the upper or first conductor. Various proposals have been disclosed which include linkbreak levers of various configurations for breaking the fuse link prior to releasing the positive latching mechanism. In use of the prior art cutouts when an overload occurs the fuse link melts thereby breaking the electrical circuit. The fuse tubes are usually fabricated from materials which on exposure to the high temperatures generated during the melting of the fuse link generate arc extinguishing gases which escape from the interior of the fuse tube through the lower end thereof. However, when the cutout is on load and for some reason it becomes necessary to disconnect the electrical load from the supply, it will be evident to those skilled in the art that if the cap is moved out of engagement with the upper conductor in order to break the electrical circuit, arcing will occur between the upper conductor and the cap which may result in damage to the upper conductor necessitating replacement of the entire cutout. In addition, this arc creates a safety concern for the lineman who is manually disconnecting the load from the supply.

In order to overcome these problems, as stated hereinbefore, various linkbreak devices have been disclosed for breaking the fuse link within the fuse tube prior to removal of the cap from engagement with the upper conductor. In the prior art, various linkbreak levers have been proposed in which the lever extends in the plane of the insulator and fuse tube such that downward movement of the lever by the lineman using an insulating line pole results in breaking of the fuse link by means of the increased tension applied to the pigtail along the length of the fuse link. Due to the moment imparted to the fuse tube by such downward pivoting of the linkbreak lever, such prior art cutouts have necessitated the use of a positive latching mechanism as stated hereinbefore for positively latching the cap into engagement with the upper conductor. Such positive latching mechanisms have involved increased overall costs in the production of such cutouts and there has existed in the art a need of a cutout in which the frictional force between the cap and upper conductor is sufficient to hold the fuse tube in position until the fuse link is broken.

However, with conventional caps, the portion of the cap which cooperates with a detent in the upper conductor is of semispherical configuration for cooperating with the spherical detent in the upper contact. The semispherical configuration of the cap does not provide sufficient frictional resistance to prevent movement of the cap away from the detent during pivotal movement of the linkbreak lever away from the fuse tube in a plane extending through the end of the insulator and the fuse tube.

In an attempt to overcome the aforementioned problem, various proposals have been disclosed wherein the handle of the linkbreak lever extends in the aforementioned plane but is pivoted upwardly towards the fuse tube in order to avoid the disengagement of the cap from the detent. However, this disposition of the linkbreak handle is relatively difficult to operate.

Furthermore, a linkbreak lever has been proposed in which the handle of the lever extends laterally relative to the aforementioned plane and this proposal while permitting the utilization of a conventional detent arrangement has proved relatively difficult to operate with a line pole because of the lateral disposition of the handle and the increasing cost of manufacture.

U.S. Pat. No. 2,514,163 to Pitman discloses a linkbreak handle which is pushed upwardly by the lineman's line pole to break the fuse link. The upward force on the handle urges the cap against the detent of the upper conductor.

U.S. Pat. No. 2,630,508 to Meisenheimer, et al. teaches a linkbreak lever handle which extends from the pivotal point 38 in a direction from the fuse tube towards the insulator, thereby disposing the handle 39 in an inaccessible location.

The present invention seeks to overcome the aforementioned inadequacies of the prior art devices by the provision of a cap having a frustoconical configuration which increases the frictional force between the cap and the detent to prevent disengagement of the cap during a linkbreak operation.

Therefore, it is a primary object of this invention to provide an electrical cutout that overcomes the inadequacies of the prior art devices and provided an improvement which significantly contributes to the low cost of manufacture of a cutout.

Another object of the present invention is the provision of an electrical cutout in which downward movement on the handle of the linkbreak lever away from the fuse tube in a direction from the insulator towards the fuse tube results in breaking of the fuse link before disengagement of the cap relative to the detent.

Another object of the present invention is the provision of an electrical cutout having a cantilever contact which defines a detent, the detent cooperating with a cap of frustoconical configuration which provides improved retentional engagement between the cap and the detent.

Another object of the present invention is the provision of an electrical cutout which avoids the necessity of providing a positive latch between the cap and the upper contact.

Another object of the present invention is the provision of an electrical cutout in which the linkbreak lever extends away from the fuse tube in a direction from the insulator towards the fuse tube.

The foregoing has outlined some of the more pertinent objects of the present invention. These objects should be construed to be merely illustrative of some of the more prominent features and applications of the invention. Many other beneficial results can be obtained by applying the disclosed invention in a different manner or modifying the invention within the scope of the invention. Particularly with regard to the use of the invention disclosed herein, this should not be construed as being limited to electrical cutouts having a single insulator but should include cutouts in which the upper and the lower conductors are respectively supported by individual insulators or the like.

SUMMARY OF THE INVENTION

The electrical cutout of the present invention is defined by the appended claims with a specific embodiment shown in the attached drawings. For the purpose of summarizing the invention, the invention relates to an electrical cutout which is electrically connected in series between a line terminal and a load terminal. The electrical cutout comprises an insulator having a first and a second end. A first electrical conductor is rigidly secured to the first end of the insulator with the first conductor being electrically connected to the line terminal. A second electrical conductor is rigidly secured to the second end of the insulator with the second conductor being electrically connected to the load terminal. A fuse tube extends between the first and the second conductors and a fuse link extends through the fuse tube. The fuse link includes a first and a second end thereof and the second end of the fuse link is electrically connected to the second conductor. Cap means are disposed adjacent the first end of the fuse link, the cap means being electrically connected to the first end of the fuse link with the cap means frictionally cooperating with the first conductor. A link break means for breaking the fuse link is pivotally connected to the second conductor such that when the linkbreak means is pivoted away from the fuse tube in a plane extending through the ends of the insulator and the fuse tube, the force required to break the fuse link creates a moment less than the moment resulting from the retention force between the first conductor and the cap means.

In a more specific embodiment of the invention, the first electrical conductor includes a U-shaped shield and a cantilever contact having a first and a second end. The first end of the cantilever contact is rigidly connected to the shield and biasing means extend between the shield and the cantilever contact for urging the second end of the cantilever contact away from the shield into frictional engagement and retention with the cap means. A detent defined by the second end of the cantilever arm receivably engages the cap means. The cap means includes a frustoconical portion for frictionally engaging and being retained in engagement with the detent in the cantilever contact. The linkbreak means also includes a handle which in use of the device is moved downwardly away from the fuse tube in a direction from the insulator towards the fuse tube for breaking the fuse link. When the fuse link is being broken the retentional force between the frustoconical portion of the cap and the detent is sufficient to maintain the cap in electrical contact with the detent.

The foregoing has outlined rather broadly the more pertinent and important features of the present invention in order that the detailed description of the invention that follows may be better understood so that the present contribution to the art can be more fully appreciated. Additionally, features of the invention will be described hereinafter which form the subject of the claims of the invention. It should be appreciated by those skilled in the art that the conception and specific embodiment described may be readily utilized as a basis for modifying or designing other devices for carrying out the same purpose as the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following description taken in conjunction with the accompanying drawings in which:

FIG. 2 is an enlarged sectional view of the linkbreak mechanism of the present invention;

FIG. 3 is a similar view to that shown in FIG. 2 but shows the linkbreak lever moving downwardly in a clockwise direction for breaking the fuse link;

FIG. 9 is a sectional view of a prior art cap means having semispherical configuration;

Similar reference characters refer to similar parts throughout the several views of the drawings.

DETAILED DESCRIPTION

Figure 1:
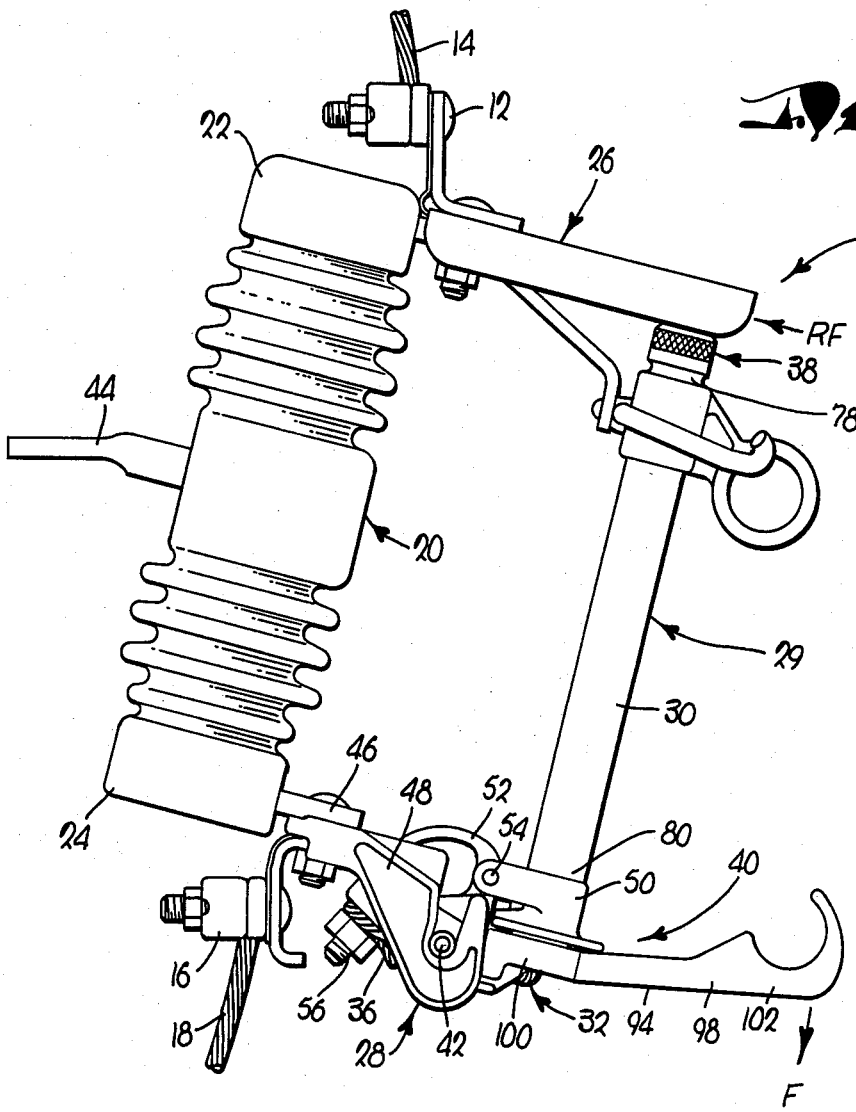
FIG. 1 is a side elevational view of the electrical cutout according to the present invention.

FIG. 1 is a side elevational view of an electrical cutout generally designated 10 of the present invention. The cutout 10 is electrically connected in series between a line terminal 12 of a line wire 14 and a load terminal 16 of a load wire 18. The cutout 10 includes an insulator generally designated 20 having a first and second end 22 and 24, respectively. A first electrical conductor generally designated 26 is rigidly secured to the upper first end 22 of the insulator 20. The first conductor 26 is electrically connected to the line terminal 12. A second electrical conductor 28 is rigidly secured to the second end 24 of the insulator 20 and the second conductor 28 is electrically connected to the load terminal 16. As shown in FIG. 1, a fuseholder 29 extends between the first and the second conductors 26 and 28, respectively, and consists of a fuse tube 30, and first and second ends 78 and 80, respectively. A fuse link generally designated 32 and described in more detail hereinafter extends through the fuse tube 30. The fuse link 32 includes a first and a second end 34 and 36, respectively. The second end or pigtail 36 of the fuse link 32 is electrically connected to the second conductor 28. Cap means 38 is disposed adjacent the first end 34 of the fuse link 32 with the cap means 38 being electrically connected to the first end 34 of the fuse link 32. The cap means 38 frictionally cooperates with the first conductor 26. A linkbreak lever means generally designated 40 for breaking the fuse link 32 is pivotally connected at 42 to the second conductor 28 such that when the linkbreak lever means 40 is pivoted away from the insulator 20 in a reference which extends through the center of ends 22 and 24 of the insulator 20 and the center of fuse tube 30, the clockwise moment created about point 42 by the force F required to break the fuse link is less than the counterclockwise moment about point 42 resulting from the retentional force RF between the first conductor 26 and the cap means 38.

As shown in FIG. 1, the insulator 20 also includes an insulator support 44 for supporting the insulator 20. The support 44 is disposed between the first and the second ends 22 and 44 respectively of the insulator 20.

Figure 5:
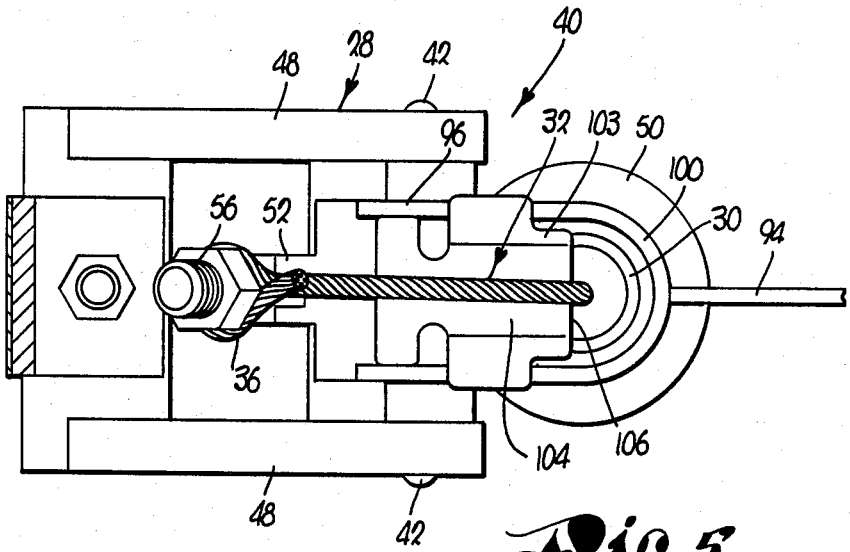
FIG. 5 is a bottom plan view of the linkbreak mechanism of the present invention with the linkbreak lever in the position shown in FIG. 1.

FIG. 1 shows the second electrical conductor 28 which also includes a first member 46 rigidly supported by the second end 24 of the insulator 20 and electrically connected to the load terminal 16. A bifurcated bracket 48 extends from the first member 46 as shown more particularly with reference to FIGS. 5 and 6.

As shown in FIGS. 2–6, a support bracket 50 is rigidly secured to the fuse tube 30. The support bracket 50 is pivotally secured to a second member 52 at 54 such that the pivotal axis 42 of the second member 52 and the pivotal axis 54 of the support bracket 50 are spaced and parallel relative to each other. An anchoring means 56 extends from the second member 52 for anchoring the second end 36 or pigtail of the fuse link 32 in electrical contact with the second member 52.

Figure 7:
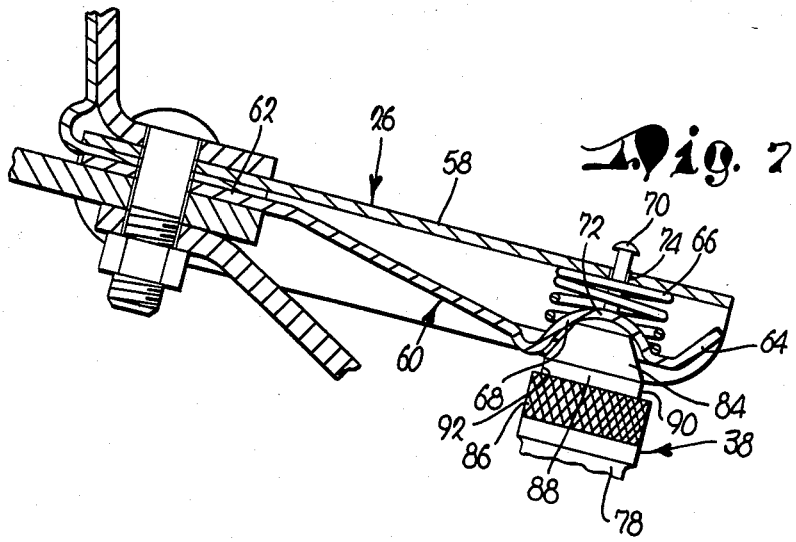
FIG. 7 is a sectional view of the first electrical conductor showing the cantilever contact, the detent and the frustoconical portion of the cap.

FIG. 7 shows the first electrical conductor 26 in more detail. The first electrical conductor 26 includes a shield 58 of U-shaped transverse sectional configuration and a cantilever contact generally designated 60 having a first and a second end 62 and 64, respectively. The first end 62 of the contact 60 is connected to the shield 58. Biasing means 66 such as a compression spring extends between the shield 58 and the second end 64 of the cantilever contact 60 for urging the second end 64 of the cantilever contact 60 away from the shield 58 into frictional engagement and retention with the cap means 38. A detent 68 is defined by the second end 64 of the cantilever contact 60 for receivably engaging the cap means 38. A pin 70 extends from the base 72 of the detent 68 through a hole 74 defined by the shield 58. The pin 70 guides the movement of the cantilever contact 60 relative to the shield 58.

Referring more particularly to FIG. 1, the fuse tube 30 also includes a first and a second end 78 and 80, respectively. The first end 78 cooperates with the first end 34 of the fuse link 32. The first end 78 of the fuse tube 30 threadably engages the cap means 38 such that the first end 34 of the fuse link 32 is secured between the first end 78 of the fuse tube 30 and the cap means 38. The second end 80 of the fuse tube 30 is pivotally secured by the support bracket 50 to the second member 52.

Figure 6:
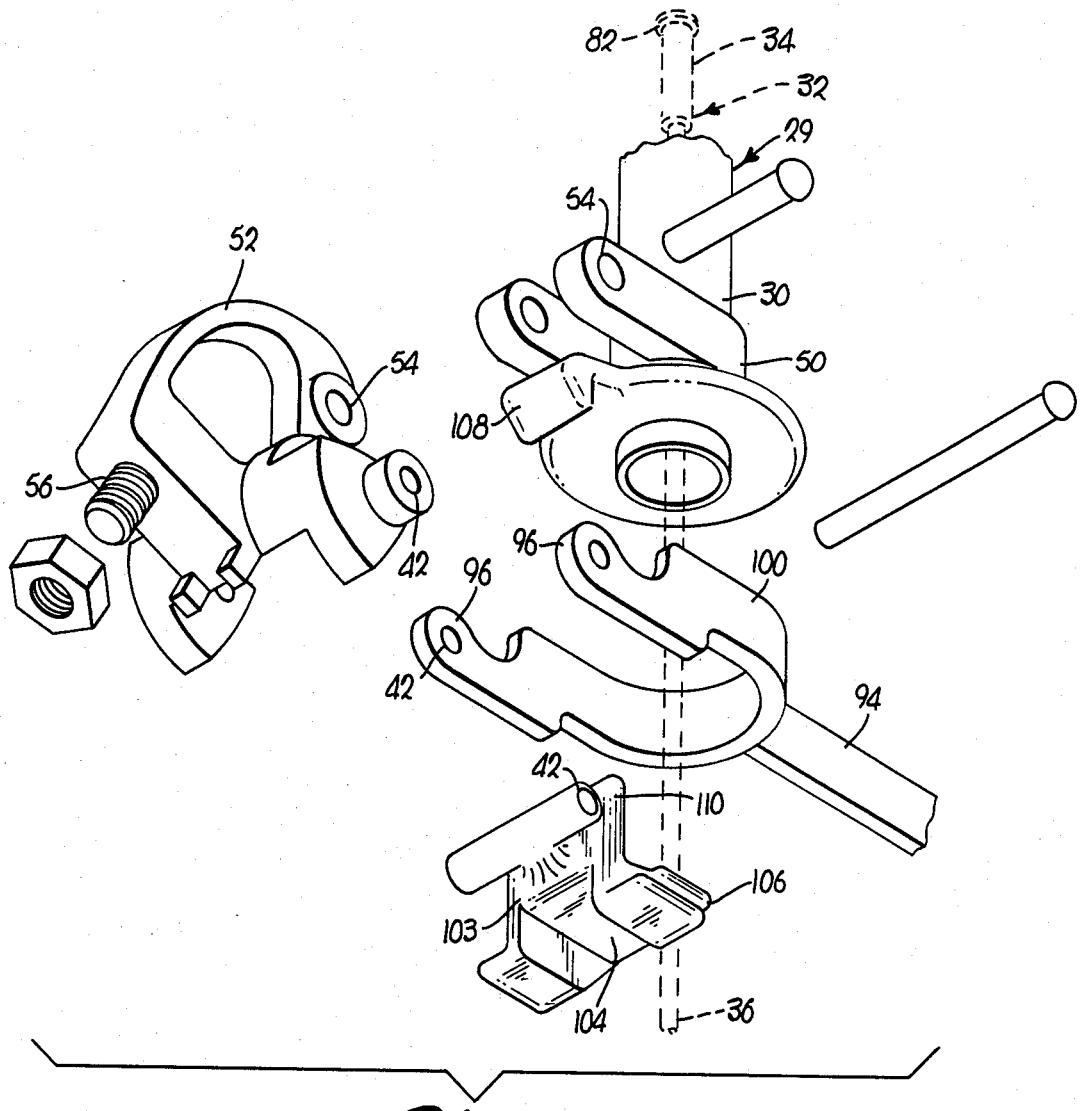
FIG. 6 is an exploded view of the linkbreak mechanism of the present invention.
Figure 4:
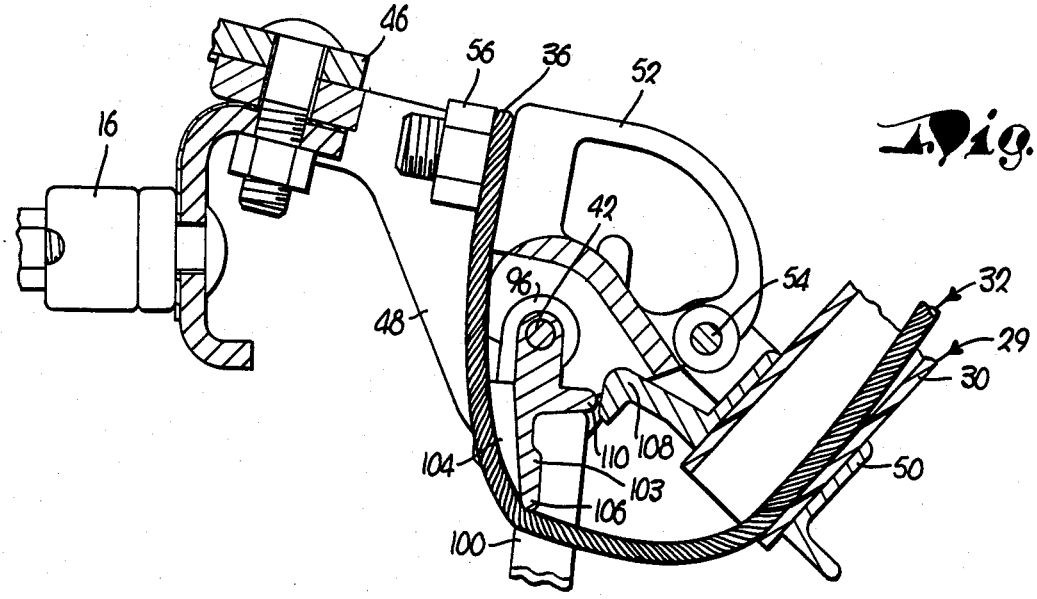
FIG. 4 is a similar view to that shown in FIGS. 2 and 3 but shows the fuse link having been broken and the fuse tube having subsequently fallen out of engagement with the detent.

FIG. 6 shows the fuse link 32 in dashed outline. The fuse link 32 includes an enlarged head 82 which is disposed adjacent the first end 34 of the fuse link 32 such that the head 82 is secured to the first end 78 of the fuse tube 30 by the cap means 38.

As shown with reference to FIG. 7, the cap means 38 includes a frustoconical portion 84 for engaging the detent 68. The cap means 38 also includes a knurled portion 86 of substantially cylindrical configuration, the knurled portion being internally threaded for threadably engaging the first end 78 of the fuse tube 30. The cap means 38 also includes a disc-shaped portion 88 disposed between the knurled portion 86 and the frustoconical portion 84. The disc-shaped portion 88 defines a pair of diametrically opposed cutaway segments 90 and 92 respectively.

FIGS. 2, 3, 4 and 6, show in more detail the interrelationship of the various parts of the second conductor 28 and the linkbreak lever means 40. A third member 94 of the linkbreak lever means 40 includes a first and a second end 96 and 98, respectively. The third member 94 also includes a bifurcated portion 100 disposed at the first end 96 of the third member 94 such that the bifurcated portion 100 is pivotally mounted at 42 such that the bifurcated portion 100 and the second member 52 pivot about the same pivotal axis. A handle 102 is disposed adjacent the second end 98 of the third member 94. A fourth member 103 is pivotally connected to the bifurcated bracket 48 and includes a guide 104 for guiding the second end or pigtail 36 of the fuse link 32.

As shown in FIGS. 2, 3, 4 and 6, the fourth member 103 includes a movable fulcrum point 106 for breaking the fuse link 32 when the handle 102 is moved away from the fuse tube 30 in the aforementioned reference plane passing through the first and second ends 22 and 24, respectively of the insulator 20 and the fuse tube 30. The fourth member is pivoted about pivot point 42 by the interengagement of the bifurcated portion 100 with the guide 104.

As shown in FIGS. 2, 3, 4 and 6, the support bracket 50 further includes a hook-shaped portion 108 which extends from the support bracket 50 towards the linkbreak lever means 40. A stop 110 extends from the fourth member 103 such that when the fuse link 32 is secured to the anchoring means 56, movement of the linkbreak lever means 40 towards the insulator 20 in the reference plane results in the stop 110 abutting against the hook-shaped portion 108 thereby forcing the cap means 38 into frictional engagement and retention with the detent 68.

As will be evident to those skilled in the art, the relative dispositions of the pivotal axis 42 and 54 is such that movement of the linkbreak lever means 40 away from the fuse tube 20 in the plane P imparts a component force to the pivotal axis 54 to urge the frustoconical portion 84 of the cap means 38 into increased frictional engagement with the detent 68 due to the increased tension along the fuse link 32 resulting from the movement of the linkbreak lever 40 during the breaking of the fuse link.

Figure 8:
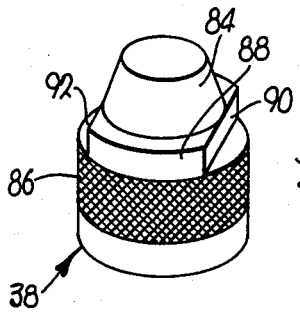
FIG. 8 is perspective view of the improved cap having a frustoconical configuration.

FIG. 9 is a sectional view of a prior art cap means 38 having a semispherical portion 72 for engagement with a standard detent 68 of the contact 60. FIG. 8 is a perspective view of the improved cap means 38 showing the frustoconical portion 84, the knurled portion 86 and the disc-shaped portion 88. The disc-shaped portion 88 includes diametrically opposed cutaway segments 90 and 92, respectively.

Figure 10:
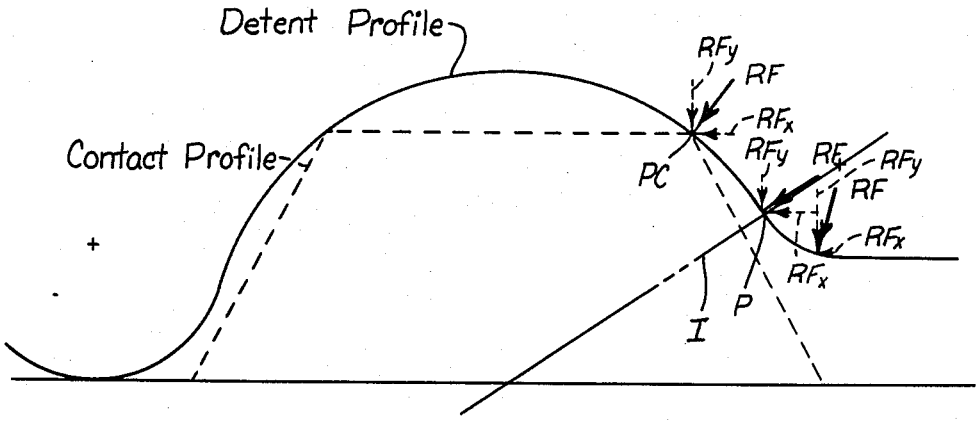
FIG. 10 is a vector diagram showing various force components acting on the cap means.

FIG. 10 is a vector diagram showing the various force components acting on the cap means 38. FIG. 10 is an exaggerated contact profile showing the inside and outside radii divided by an intersecting line I. Above the intersecting line I, the force F on the cap to resist unlatching starts nearly vertical and rotates clockwise as the cap moves down the contact profile. At the intersecting line I, the force F is at its maximum clockwise position and begins to rotate counterclockwise as movement is continued along the contact profile beyond the intersecting line. Resolving the force F into its vertical and horizontal components Fy and Fx respectively reveals that the components will vary in magnitude as the force F rotates along the contact profile. The horizontal component Fx of this force F coupled with the moment arm creates the resistance to the unlatching moment caused by downward movement of the handle of the linkbreak lever.

The cap means 38 of the present invention provides a point of contact between the frustoconical portion 84 and the detent 68 and this point of contact and the force is above the intersecting line I thereby providing the maximum resistance to the unlatching moment whereas with the prior art semispherical cap profile, the force F acts at or somewhat below the intersecting line I resulting in a lesser and continually decreasing resistance to the unlatching moment.

The present invention utilizes the shape of the cap means to provide forces in the design directions but also creates greater magnitude forces than the prior art semispherical caps by being slightly taller and having a sharp corner to allow a somewhat higher co-efficient of friction. The taller shape of the cap of the present invention allows the cap to project further into the detent 68 providing a slightly longer moment arm than the prior art (i.e. spherical) cap thereby further increasing the resistance to the unlatching moment.

As shown in FIG. 10, the detent profile includes a point P intersected by the intersecting line I. At this point P of the profile the force Fy exerted by the spring 66 is relatively small whereas the force Fx representing the force tending to pull the cap means out of engagement with the detent 68 is relatively large. However, at the point of contact PC between the edge of the frustoconical portion 84 and the detent, the force Fy is relatively large and the force Fx relatively small. In view of this, it is evident that the vector forces exerted on the portion 84 during movement of the portion 84 from PC to P are relatively great which enables the cap to be retained in the detent during linkbreak operations. However, in the prior art, the vector forces from the point P progressively rotate in a counterclockwise direction and the force imparted to the cap due to the linkbreak operation easily disengages the cap from the detent.

Operation of the electrical cutout of the present invention enables the fuse link 32 to be easily broken by the application of a downward force to the handle 102 in a direction away from the fuse tube 30 and in the reference plane.

With the prior art cutouts of this type, it has previously been necessary to incorporate at the first end 78 of the fuse tube 30 a relatively complex positive latch arrangement for insuring that the cap 38 does not disengage from the first conductor 36 during such linkbreak operation. The present invention provides a novel configuration of the cap means 38 to increase the frictional and retentional engagement force between the frustoconical portion 84 of the cap means 38 and the detent 68. The angular edges of the frustoconical portion 84 as opposed to the prior art semispherical configuration of the cap provides the necessary increased retentional engagement between the cap and the detent thereby avoiding the necessity of providing a costly positive latch mechanism. At the same time, the linkbreak mechanism of the present invention provides a linkbreak lever means 40 having a handle 102 that extends to a location that is easily accessible to the lineman such that the lineman with the aid of a line pole may easily engage the handle and pull the same downwardly to firstly break the fuse link 32 and secondly thereby permit the disengagement of the frustoconical portion 84 from the detent.

The present invention not only provides an electrical cutout which avoids the need of a costly positive latch mechanism but also provides a linkbreak lever which is located in an ideal position for operation by a lineman.

The frustoconical portion of the cap means as compared with the prior art semispherical cap provides the following advantages. Firstly, when such a frustoconical portion is used, the cutout does not require a positive latch mechanism, therefore the number of parts required in the fabrication of the cutout is reduced thereby reducing the costs.

Secondly, when a frustoconical cap is used as a part of the invention, a standard fuseholder or a linkbreak fuseholder may be used interchangeably in a cutout employing a detent-type cantilever contact.

Thirdly, the handle being positioned in the same plane as the insulator to the fuse tube for pulling in a downwardly direction is ideal for obtaining safest operating direction when breaking the link.

Fourthly, the handle is easily accessible in the front disposition thereof from a variety of different servicing positions.

The present disclosure includes that contained in the appended claims as well as that of the foregoing description. Although this invention has been described in its preferred form with a certain degree of particularity, it is to be understood that the present disclosure of the preferred form has been made by way of example and that numerous changes in the details of construction and the combination and arrangement of parts may be resorted to without departing from the spirit and scope of the invention.

What is claimed is:

1. An electrical cutout electrically connected in series between a line terminal and a load terminal, said cutout comprising in combination:

an insulator having a first and a second end;

a first electrical conductor rigidly secured to said insulator adjacent said first end of said insulator, said first conductor being electrically connected to the line terminal;

a second electrical conductor rigidly secured to said insulator adjacent said second end of said insulator, said second conductor being electrically connected to the load terminal;

a fuse tube extending between said first and said second conductors;

a fuse link extending through said fuse tube, said fuse link including a first and a second end, said second end of said fuse link being electrically connected to said second electrical conductor;

cap means disposed adjacent said first end of said fuse link, said cap means being electrically connected to said first end of said fuse link, said cap means frictionally enaging said first conductor and being normally retained in said frictional engagement, there being a moment which results from said retention force between said first conductor and said cap means; and an elongated linkbreak lever means pivotally connected to said second conductor for swinging movement in an upright plane, said lever means extending outwardly from said second conductor in a direction generally away from said insulator, the longitudinal axis of said lever means lying normally in a generally horizontal plane, said lever means being operable to break said fuse link as said lever means is moved downwardly, such that the force required to break said fuse link creates a moment less than said moment resulting from said retention force between said first conductor and said cap means to cause said cap means to be retained by said first conductor in frictional engagement with said first conductor as said fuse link is broken.

2. An electrical cutout as set forth in claim 1 wherein said insulator further includes:

an insulator support for supporting said insulator, said support being disposed between said first and said second end of said insulator.

3. An electrical cutout as set forth in claim 1, wherein said fuse tube further includes:

a first and a second end, said first end cooperating with said first end of said fuse link, said first end of said fuse tube threadably engaging said cap means such that said first end of said fuse link is secured between said first end of said fuse tube and said cap means.

4. An electrical cutout as set forth in claim 1 wherein said fuse link further includes:

an enlarged head disposed adjacent said first end thereof such that said head is secured to said fuse tube by said cap means.

5. The invention of claim 1, wherein said cap means has a sharp corner frictionally engageable with said first conductor for providing said retention force.

6. The invention of claim 1, wherein said fuse tube is generally upright in disposition such that said retention force is comprised of a horizontal component and a vertical component with said horizontal component increasing in magnitude during initial movement of said lever means as said lever means is moved to break said fuse link.

7. An electrical cutout electrically connected in series between a line terminal and a load terminal, said cutout comprising in combination:

an insulator having a first and a second end;

a first electrical conductor rigidly secured to said first end of said insulator, said first conductor being electrically connected to the line terminal;

a second electrical conductor rigidly secured to said second end of said insulator, said second conductor being electrically connected to the load terminal;

a fuse tube extending between said first and said second conductors;

a fuse link extending through said fuse tube, said fuse link including a first and a second end, said second end of said fuse link being electrically connected to said second electrical conductor;

cap means disposed adjacent said first end of said fuse link, said cap means being electrically connected to said first end of said fuse link, said cap means frictionally engaging said firs conductor and being normally retained in said frictional engagement, there being a moment which results from said retention force between said first conductor and said cap means; and linkbreak lever means for breaking said fuse link, said linkbreak lever means being pivotally connected to said second conductor such that when said linkbreak means is pivoted away from said fuse tube in a plane extending through said ends of said insulator and said fuse tube, the force required to break said fuse link creates a moment less than said moment resulting from said retention force between said first conductor and said cap means, said first conductor including:

a U-shaped shield;

a cantilever contact having a first and a second end, said first end being rigidly connected to said shield;

biasing means extending between said shield and said second end of said cantilever contact for urging said second end of said cantilever contact away from said shield into frictional engagement with said cap means;

a detent defined by said second end of said cantilever contact for receivably engaging said cap means.

8. An electrical cutout as set forth in claim 7 wherein said cap means further includes:

a frustoconical portion for frictionally engaging said detent.

9. An electrical cutout as set forth in claim 8, wherein said cap means further includes:

a knurled portion of substantially cylindrical configuration, said knurled portion being internally threaded for threadably engaging said fuse tube;

a disc-shaped portion disposed between said knurled portion and said frustoconical portion, said disc-shaped portion defining a pair of diametrically opposed cut away segments.

10. An electrical cutout electrically connected in series between a line terminal and a load terminal, said cutout comprising in combination:

an insulator having a first and a second end;

a first electrical conductor rigidly secured to said first end of said insulator, said first conductor being electrically connected to the line terminal;

a second electrical conductor rigidly secured to said second end of said insulator, said second conductor being electrically connected to the load terminal;

a fuse tube extending between said first and said second conductors;

a fuse link extending through said fuse tube, said fuse link including a first and a second end, said second end of said fuse link being electrically connected to said second electrical conductor;

cap means disposed adjacent said first end of said fuse link, said cap means being electrically connected to said first end of said fuse link, said cap means frictionally enaging said first conductor and being normally retained in said frictional engagement, there being a moment which results from said retention force between said first conductor and said cap means; and linkbreak lever means for breaking said fuse link, said linkbreak lever means being pivotally connected to said second conductor such that when said linkbreak means is pivoted away from said fuse tube in a plane extending through said ends of said insulator and said fuse tube, the force required to break said fuse link creates a moment less than said moment resulting from said retention force between said first conductor and said cap means, said second conductor including:

a first member rigidly supported by said second end of said insulator and electrically connected to said load terminal;

a bifurcated bracket extending from said first member;

a second member pivotally secured to said bracket such that said second member pivots along said plane;

a support bracket rigidly secured to said fuse tube, said support bracket being pivotally secured to said second member such that the pivotal axis of said second member and said support bracket are spaced and parallel relative to each other;

anchoring means extending from said second member for anchoring said second end of said fuse link in electrical contact with said second member.

11. An electrical cutout as set forth in claim 10, wherein said fuse tube further includes:

a first and a second end, said second end being pivotally secured by said support bracket to said second member.

12. An electrical cutout as set forth in claim 10, wherein said linkbreak lever means includes:

a third member having a first and a second end, said third member further including:

a bifurcated portion disposed adjacent said first end of said third member, said bifurcated portion being pivotally connected to said bifurcated bracket such that said third member pivots along said plane;

a handle disposed adjacent said second end of said third member;

a fourth member pivotally connected to said bifurcated bracket such that said third member pivots along said plane, said fourth member further including:

a guide for guiding said second end of said fuse link.

13. An electrical cutout as set forth in claim 12, wherein said fourth member further includes:

a movable fulcrum point for breaking said fuse link when said handle is moved away from said fuse tube in said plane.

14. An electrical cutout as set forth in claim 13, wherein said support bracket further includes:

a hook-shaped portion extending from said support bracket toward said linkbreak lever means said fourth member further including:

a stop extending from said fourth member such that when said fuse link is secured to said anchoring means, movement of said linkbreak lever means toward said insulator in said plane results in said stop abutting against said hook-shaped portion thereby forcing said cap means into frictional engagement with said first conductor.

15. An electrical cutout as set forth in claim 10, wherein said pivotal axes of siad second member and said pivotal axis of said support bracket are positioned such that movement of said linkbreak lever means away from said fuse tube in said plane imparts a moment to urge said cap means into increased frictional engagement with said first electrical conductor due to the increased tension along the fuse link resulting from said movement of said linkbreak lever during the breaking of said fuse link.

16. An electrical cutout electrically connected in series between a line terminal and a load terminal, said cutout comprising in combination:

an insulator having a first and a second end;

a first electrical conductor rigidly secured to said first end of said insulator, said first conductor being electrically connected to the line terminal;

a second electrical conductor rigidly secured to said second end of said insulator, said second conductor being electrically connected to the load terminal;

a fuse tube extending between said first and said second conductors;

a fuse link extending through said fuse tube, said fuse link including a first and a second end, said second end of said fuse link being electrically connected to said second electrical conductor;

cap means disposed adjacent said first end of said fuse link, said cap means being electrically connected to said first end of said fuse link, said cap means frictionally enaging said first conductor and being normally retained in said frictional engagement, there being a moment which results from said retention force between said first conductor and said cap means; and linkbreak lever means for breaking said fuse link, said linkbreak lever means pivotally connected to said second conductor such that when said linkbreak means is pivoted away from said fuse tube in a plane extending through said ends of said insulator and said fuse tube, the force required to break said fuse link creates a moment less than said moment resulting from said retention force between said first conductor and said cap means, said cap means including:

a frustoconical portion for frictionally engaging said first conductor.

17. An electrical cutout electrically connected in series between a line terminal and a load terminal, said cutout comprising in combination:

an insulator having a first and a second end;

a first electrical conductor rigidly secured to said first end of said insulator, said first conductor being electrically connected to the line terminal;

a second electrical conductor rigidly secured to said second end of said insulator said second conductor being electrically connected to the load terminal;

a fuse tube extending between said first and said second conductors;

a fuse link extending through said fuse tube, said fuse link including a first and a second end, said second end of said fuse link being electrically connected to said second electrical conductor;

cap means disposed adjacent said first end of said fuse link, said cap means being electrically connected to said first end of said fuse link, said cap means including a frustoconical portion for normally frictionally engaging and being retained in engagement with said first conductor, there being a moment which results from the retention force between said first conductor and said cap means;

linkbreak lever means for breaking said fuse link, said linkbreak lever means being pivotally connected to said first conductor such that when said linkbreak lever means is pivoted away from said fuse tube in a plane extending through said ends of said insulator and said fuse tube, the moment created by the force required to break said fuse link is opposite in direction and less than said moment resulting from the retention force between said first conductor and said frustoconical portin of said cap means.

18. An electrical cutout electrically connected in series between a line terminal and a load terminal, said cutout comprising in combination:

an insulator having a first and a second end;

a first electrical conductor rigidly secured to said first end of said insulator, said first conductor being electrically connected to the line terminal, said first electrical conductor further including:

a U-shaped shield;

a cantilever contact having a first and a second end, said first end being rigidly connected to said shield;

biasing means extending between said shield and said cantilever contact for urging said second end of said cantilever contact away from said shield;

a detent defined by said second end of said cantilever arm;

a second electrical conductor rigidly secured to said second end of said insulator, said second conductor being electrically connected to the load terminal;

a fuse tube extending between said first and said second conductors;

a fuse link extending through said fuse tube, said fuse link including a first and a second end, said second end of said fuse link being electrically connected to said second electrical conductor;

cap means disposed adjacent said first end of said fuse link, said cap means being electrically connected to said first end of said fuse link, said cap means further including:

a frustoconical portion for normally frictionally enaging and being retained in engagement with said detent, there being a moment which results from the retention force between said detent and said frustoconical portion of said cap means;

linkbreak lever means for breaking said fuse link, said linkbreak lever means being pivotally connected to said second conductor such that when said linkbreak lever means is pivoted away from said fuse tube in a plane extending through said ends of said insulator and said fuse tube, the moment created by the force required to break said fuse link is opposite in direction and less than said moment resulting from the retention force between said detent and said frustoconical portion of said cap means.

* * * * *